United States Patent [19]

Lechner et al.

[11] Patent Number: 4,753,411

[45] Date of Patent: Jun. 28, 1988

[54] PORTABLE BEACH UMBRELLA SAFETY BASE

[76] Inventors: Walter Lechner, 21 Mee La., New Providence, N.J. 07974; Diane Macri, 1080 Sylvan La., Mountainside, N.J. 07092

[21] Appl. No.: 86,777

[22] Filed: Aug. 19, 1987

[51] Int. Cl.[4] ..... E02D 5/74

[52] U.S. Cl. ..... 248/533; 52/162; 52/165; 248/156; 248/545; 248/DIG. 10

[58] Field of Search ..... 248/545, 156, 530, 532, 248/533, DIG. 10; 52/165, 160, 162

[56] References Cited

U.S. PATENT DOCUMENTS

| | | | |
|---|---|---|---|
| 88,420 | 3/1869 | Sherwood | 108/151 |
| 210,283 | 11/1878 | Whittier | 52/162 |
| 1,373,665 | 4/1921 | Lozon | 248/156 |
| 1,636,617 | 7/1927 | Scott | 52/160 |
| 1,844,273 | 2/1932 | Colvin | 52/162 |
| 1,982,569 | 11/1934 | Byrd | 52/728 |
| 2,211,283 | 8/1940 | Mercer | 248/545 |
| 2,295,431 | 9/1942 | Shepard | 248/530 |
| 2,876,974 | 3/1959 | Liftman | 248/533 |

FOREIGN PATENT DOCUMENTS

| | | | |
|---|---|---|---|
| 734243 | 5/1966 | Canada | 248/156 |
| 2539079 | 3/1977 | Fed. Rep. of Germany | 248/156 |
| 6881 | of 1915 | United Kingdom | 108/151 |

*Primary Examiner*—Henry E. Raduazo
*Attorney, Agent, or Firm*—Jerry T. Kearns

[57] ABSTRACT

A base for securement of a beach umbrella includes a collar which is inserted over the staff of a beach umbrella and has four pivotable struts which open into a position in which they extend perpendicular to the staff of the umbrella. Two semicircular plates are received by the support struts and in use are covered with sand to provide a secure mounting for the ground inserted staff of the umbrella.

8 Claims, 2 Drawing Sheets

PORTABLE BEACH UMBRELLA SAFETY BASE

BACKGROUND OF THE INVENTION

1. Field of the Invention

The present invention relates to portable beach umbrella safety bases, and more particularly pertains to embodiments of a new and improved portable beach safety base which includes the use of pivotable support struts and detachable support plates.

2. Description of the Prior Art

Various types of portable umbrellas for ground insertion are known in the prior art. Typical examples of such portable ground insertable umbrellas are shown by U.S. Pat. No. 2,296,666, which issued to H. Haupt on Sept. 22, 1942, U.S. Pat. No. 2,503,032, which issued to P. De Samelson on Apr. 4, 1950, U.S. Pat. No. 2,951,492, which issued to S. Small on Sept. 6, 1960, U.S. Pat. No. 4,023,582, which issued to R. Buzzella on May 17, 1977, and U.S. Pat. No. 4,077,421, which issued to T. Schultes et al on Mar. 7, 1978. While these patents disclose various folding mechanisms for the canopy of portable umbrellas, they do not disclose an adequate supporting base for use when the staff of the umbrella is to be inserted in the sand of a beach. Due to the easily displaceable nature of beach sand and the prevailing windy conditions to be found along beaches, there is a need for a secure and portable supporting base for beach umbrellas.

As evidenced by the above cited U.S. patents, which merely disclose ground inserted staffs for supporting portable beach umbrellas, it can be appreciated that there is a continuing need for, and interest in, improvements in the securement of such portable beach umbrellas, and in this respect, the present invention addresses this need and interest.

SUMMARY OF THE INVENTION

In view of the foregoing disadvantages inherent in the known types of portable beach umbrella bases now present in the prior art, the present invention provides an improved portable beach umbrella safety base. As such, the general purpose of the present invention, which will be described subsequently in greater detail, is to provide a new and improved portable beach umbrella safety base which has all the advantages of the prior art portable beach umbrella bases and none of the disadvantages.

To attain this, representative embodiments of the concepts of the present invention are illustrated in the drawings, and make use of hollow collar elements having support struts pivotably secured thereto. The various embodiments of the invention, only two of which are illustrated in the drawings for conceptual purposes, make use of pivotable support struts which can be moved relative to a hollow mounting collar between opened and closed positions. Additionally, removable support plates are provided to be supported by the support struts in their opened position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable beach umbrella safety base which has all the advantages of the prior art portable beach umbrella bases and none of the disadvantages.

It is another object of the present invention to provide a new and improved portable beach umbrella safety base which may be easily and efficiently manufactured and marketed.

It is a further object of the present invention to provide a new and improved portable beach umbrella safety base which is of a durable and reliable construction.

An even further object of the present invention is to provide a new and improved portable beach umbrella safety base which is susceptible of a low cost of manufacture with regard to both materials and labor, and which accordingly is then susceptible of low prices of sale to the consuming public, thereby making such portable beach umbrella safety bases economically available to the buying public.

Still yet another object of the present invention is to provide a new and improved portable beach umbrella safety base which provides in the apparatuses and methods of the prior art some of the advantages thereof, while simultaneously overcoming some of the disadvantages normally associated therewith.

Still another object of the present invention is to provide a new and improved portable beach umbrella safety base which makes use of pivotable support struts in combination with a hollow collar and detachable support plates.

Yet another object of the present invention is to provide a new and improved portable beach umbrella safety base which may be quickly assembled and makes use of readily available beach sand as part of the support system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
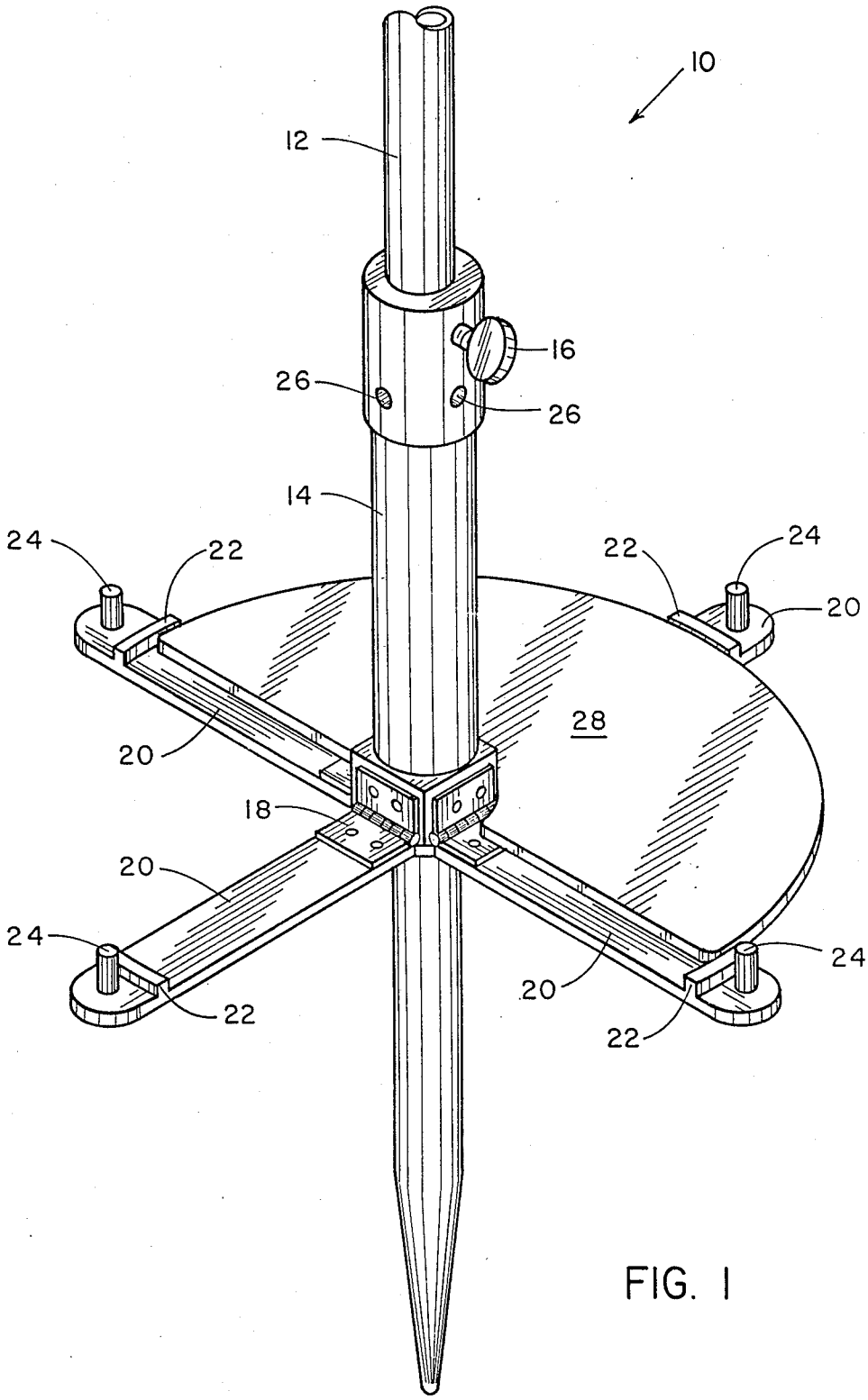
FIG. 1 is a perspective view of a first embodiment of a portable beach umbrella safety base comprising the present invention.

With reference now to the drawings, and in particular to FIG. 1 thereof, a new and improved portable beach umbrella safety base embodying the principles and concepts of the present invention and generally designated by the reference numeral 10 will be described.

More specifically, it will be noted that the first embodiment 10 of the invention includes a hollow collar 14 which is inserted over the umbrella staff 12 and is secured thereto by a thumb screw 16. A plurality of thumb screws may be provided if so desired. A plurality of support struts 20 are pivotably secured to the hollow collar 14 by hinges 18. The support struts 20 are thus mounted for movement between the illustrated opened position and a closed position in which the struts extend parallel to the longitudinal axis of the umbrella staff 12. Locating projections 22 are provided on each of the support struts 20, and serve to align two semicircular plate elements 28 in position on the support struts 20. Only one of the semicircular plates is illustrated for purposes of clarity. The second semicircular plate element is positioned in mirror image relationship to the illustrated semicircular plate element 28. Each of the support struts 20 is also provided with a retaining pin 24, adapted to be received in corresponding apertures 26 in the hollow collar 14, when the supporting struts 20 are pivoted to their closed position in which they extend parallel to the longitudinal axis of the umbrella staff 12.

The manner of usage of the portable beach umbrella safety base of the invention is as follows: the hollow collar 14 is slipped over the umbrella staff 12 to an arbitrary level at a sufficient distance from the ground inserted end of the umbrella staff. Support struts 20 are at this time in their closed position extending parallel to the longitudinal axis of the umbrella staff and are locked in this position by retaining pins 24 received in the aforesaid apertures 26. The hollow collar is then secured to the umbrella staff 12 by tightening thumb screw 16. At this time, the staff of the umbrella is thrust as far as possible, or as far as desired into the sand of the beach. Thumb screw 16 is then loosened and hollow collar 14 is slid downwardly on umbrella staff 12 until the bottom of the hollow collar is resting on the surface of the beach. Thumb screw 16 is then tightened. At this stage, support struts 20 are pivoted into a position in which they extend perpendicular to the longitudinal axis of the umbrella staff, and then two semicircular plates 28 are positioned as illustrated on the support struts. Sand from the beach is then piled upon the semicircular plates, preferably in a conical form, to accummulate a large volume of sand on the semicircular plates. As is readily apparent, the weight of the sand serves to anchor the beach umbrella against the lateral shifting motion commonly induced by wind force on the canopy of the umbrella.

When it is desired to remove the umbrella from the beach, sand is first brushed away to an extent sufficient to allow removal of the semicircular plates 28, then the umbrella staff is pulled from the sand. Support struts 20 are pivoted to their closed position and secured therein by the reception of retaining pins 24 in apertures 26. Semicircular plates 28 are of a sufficiently small size to be readily transported in a standard beach bag. The hollow collar 14 remains secured to the beach umbrella staff 12 and is transported for storage therewith.

Figure 2:
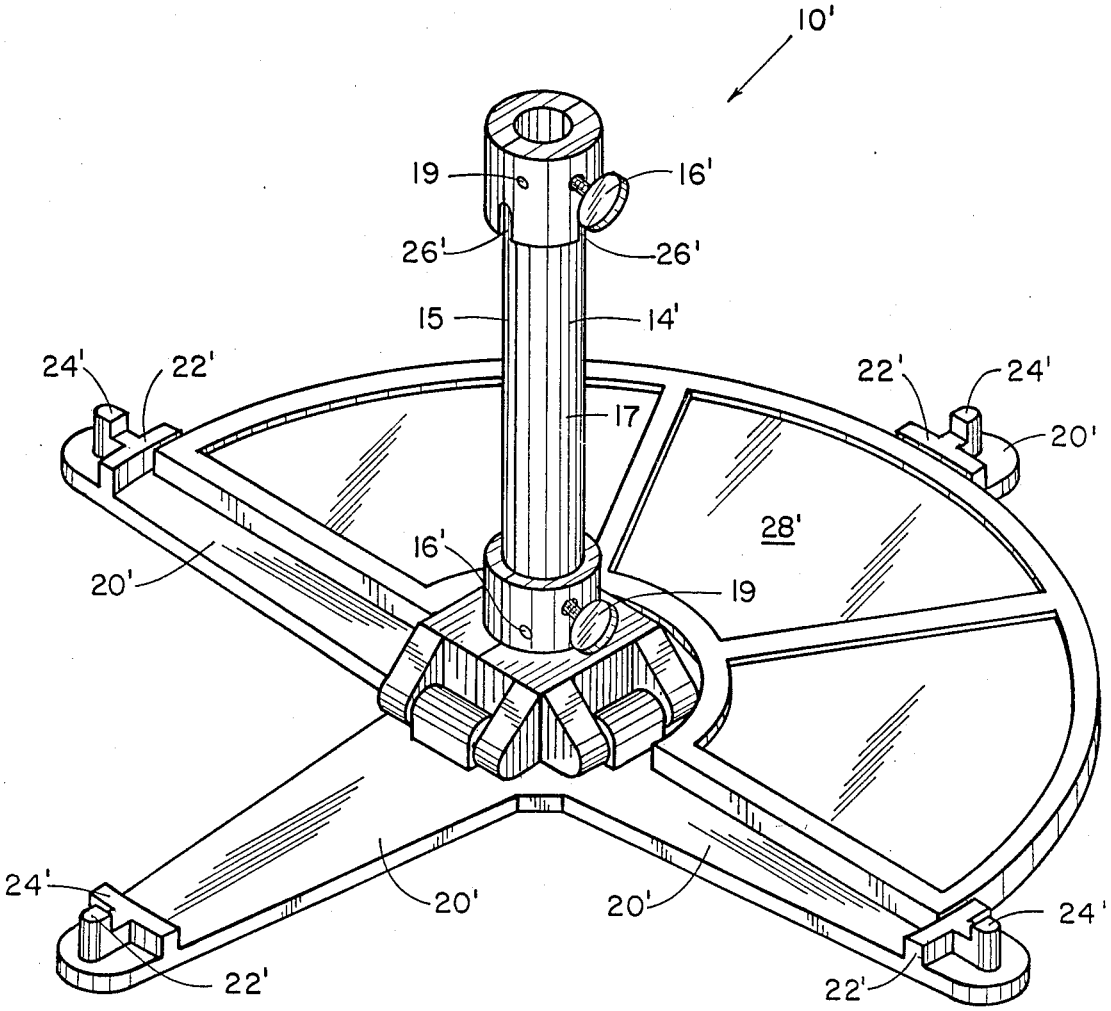
FIG. 2 is a perspective view of a second embodiment of the invention.

With reference now to FIG. 2, a second embodiment of a portable beach umbrella safety base 10′ is illustrated in which the hollow collar 14′ is constructed as two semicircular half collars 15 and 17. These half collars 15 and 17 are secured together to form a hollow collar by a plurality of screws 19. Integrally formed with the semicircular half collars 15 and 17 are hinge portions 18′. Support struts 20′ are provided with cooperating integral hinge portions. Locating projections 22′ for the semicircular plates as well as retaining pins 24′ are also integrally moulded on support struts 20′. Corresponding apertures 26′ are integrally moulded on semicircular half collars 15 and 17. Semicircular plates 28′, only one of which is illustrated for purposes of clarity, are provided with integrally moulded reinforcing ribs. Each of the elements of the FIG. 2 embodiment of the portable beach umbrella safety base are preferably constructed from moulded plastic to ensure economical production as well as to be light in weight for ease of portability. It is also contemplated that the elements may be formed from sheet metal, cast metal, wood or any other suitable material.

The manner of usage of the embodiment of FIG. 2 is precisely analogous to that previously defined in relation to the FIG. 1 embodiment, and accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable safety base for a beach umbrella having a staff for insertion into a sandy beach, said safety base comprising:

hollow collar means for insertion around said umbrella staff;

means for securing said collar means to said umbrella staff;

a plurality of support strut means pivotally connected to said collar means for movement into a closed position wherein said support strut means extend generally parallel to a longitudinal axis of said umbrella staff and an opened position wherein said support strut means extend generally perpendicular to said longitudinal axis of said umbrella staff;

plate means adapted to be supported by said support strut means in said opened position;

means for securing said support strut means in said closed position;

said support strut securing means comprising retaining pin means formed on each of said support strut means and aperture means for the reception of said retaining pin means formed in said hollow collar means.

2. The portable safety base of claim 1 further comprising locating projection means on said support strut means for locating said plate means in proper position.

3. The portable safety base of claim 1 wherein said support strut means comprise four equally spaced support struts pivotally secured to said hollow collar means by hinge means.

4. The portable safety base of claim 1 wherein said plate means comprises two semicircular plates each having a semicircular central opening.

5. The portable safety base of claim 1 wherein said means for securing said collar to said umbrella staff comprises at least one thumb screw.

6. The portable safety base of claim 1 wherein said hollow collar means comprises two semicircular collar halves secured together and provided with integrally formed hinge portions.

7. The portable safety base of claim 1 wherein said support strut means comprise molded plastic members having integral hinge portions.

8. The portable safety base of claim 1 wherein said plate means comprise two semicircular molded plastic plates each having semicircular central openings and integrally formed reinforcing ribs.

* * * * *